United States Patent [19]

Liebl

[11] 4,246,481

[45] Jan. 20, 1981

[54] CONTACT IONIZATION APPARATUS

[75] Inventor: Helmut Liebl, Eching, Fed. Rep. of Germany

[73] Assignee: Max-Planck-Gesellschaft zur Foerderung der Wissenschaften E.V., Goettingen, Fed. Rep. of Germany

[21] Appl. No.: 10,409

[22] Filed: Feb. 8, 1979

[30] Foreign Application Priority Data

Feb. 8, 1978 [DE] Fed. Rep. of Germany ..... 2805273

[51] Int. Cl.[3] ..... H01J 27/00

[52] U.S. Cl. ..... 250/423 R; 250/424; 250/426; 313/351

[58] Field of Search ..... 313/336, 362, 351; 250/423, 423 F, 424, 426

[56] References Cited

U.S. PATENT DOCUMENTS

| | | | |
|---|---|---|---|
| 2,809,314 | 10/1957 | Herb | 250/423 F |
| 3,336,475 | 8/1967 | Kilpatrick | 250/423 |
| 3,355,615 | 11/1967 | Le Bihan et al. | 250/423 |
| 4,088,919 | 5/1978 | Clampitt | 313/351 |

OTHER PUBLICATIONS

"Electrohydrodynamic Ion Source", by John F. Mahoney et al., Journal of Applied Physics, vol. 40, No. 13, 12/69, pp. 5101–5105.

*Primary Examiner*—Harold A. Dixon

*Attorney, Agent, or Firm*—Brisebois & Kruger

[57] ABSTRACT

An arrangement wherein atoms are ionized by contact with a heated ionizing surface and the ions are accelerated along an acceleration path towards an acceleration electrode, and wherein, in order to achieve high current densities, the heated surface is convexly curved towards the acceleration electrode and has a radius of curvature which is substantially smaller than the length of the acceleration path.

18 Claims, 2 Drawing Figures

CONTACT IONIZATION APPARATUS

FIELD OF THE INVENTION

The present invention relates to an arrangement for the production of a beam of accelerated ions by contact ionization of atoms at a heated surface and acceleration of the ions produced at the surface along an acceleration path extending from the surface towards an acceleration electrode.

PRIOR ART

Arrangements of this type, which may conveniently be referred to as "thermal surface ion sources," are described, for example, in the book "Ion beams" by R. G. Wilson and G. R. Brewer published by Wiley-Interscience, New York, 1973. They are based on the effect that if neutral atoms impinge upon a surface, which is sufficiently hot to prevent the atoms being adsorbed at the surface, a proportion of the atoms are ionized upon leaving the surface. The ionization ratio R, that is to say the ratio of the ions to the total number of particles leaving the surface, follows the Saha-Langmuir Law, according to which the ionization ratio $R_+$ for positive ions is expressed by:

$$R_+ = \frac{n_+}{n_0 + n_-} = \left(1 + \omega_+ \exp\frac{I - W}{kT}\right)^{-1} \quad (1)$$

and the ionization ratio $R_-$ for negative ions is expressed by:

$$R_- = \frac{n_-}{n_0 + n_-} = \left(1 + \omega_- \exp\frac{W - E}{kT}\right)^{-1} \quad (2)$$

wherein

W = the electron work function of the surface

I = the ionization energy of the atoms

E = the electron affinity of the atoms

T = the surface temperature k = the Boltzmann constant $\omega_+$ and $\omega_-$ are statistical factors for positive and negative ions respectively (for alkali metals $\omega_+ = 2$ and for halogens $\omega_- = 4$).

If $W - I > 0.4$ eV and $E - W > 0.4$ eV, then $R_+$ and $R_-$ assume almost the value of unity, i.e. almost all the atoms, which impinge on the surface, evaporate as positive or negative ions. Thus, for example, caesium vapour (I = 3.88 eV) impinging upon a hot (1400° K.) tungsten surface (W = 4.54 eV) is almost completely positively ionized, whilst, on the other hand, iodine vapour, for example (E = 3.12 eV) impinging upon a hot lanthanum-hexaboride surface (W = 2.70 eV) is almost completely negatively ionized. Similar high ionization levels may also be achieved for other alkali metals and halogens.

It is already known to introduce the vapour particles which are to be ionized from the front onto the hot surface, or alternatively to convey them from the rear through a hot frit of the particular material bearing the hot surface, so as to allow them to diffuse out of the then porous hot surface. The resulting ions are then withdrawn from the surface by an electrical field. The attainable current densities J are limited in the above mentioned cases by Child's Space Charge Law, which states for a plane arrangement that:

$$J = \frac{5.45 \times 10^{-8}}{\sqrt{M}} \cdot \frac{V^{3/2}}{d^2} \cdot A \text{ cm}^{-2} \quad (3)$$

wherein

V = the acceleration voltage

M = the mass number d = the spacing distance between the ionizing surface and the extraction electrode.

The maximum applied voltage is limited by the breakdown strength of the acceleration path. The vapour pressure in the acceleration path can be increased to a value at which the mean free path is substantially equal to the spacing distance d. For example where d = 5 mm, a vapour pressure of Cs up to 1 Pa is permissible. This corresponds to a particle flux density of about $10^{18}$ $cm^{-2}s^{-1}$ or, when converted, can be expressed as an equivalent particle current density of about 200 mA $cm^{-2}$. In the case of unimpeded extraction of the ions this would be the saturation current density. However, from Equation (3) there is obtained, for this example with V = 10 kV, a space charge limited current density of only about 20 mA $cm^{-2}$. This is the same order of magnitude as the maximum values of current density previously achieved in the prior art, i.e. approximately one tenth of the saturation current density.

The energy of the ions produced by such an ion source obeys a Maxwell distribution corresponding to the temperature of the surface. In the case of a hot surface at 1400 K. the mean initial energy of the ions is equal to 0.17 eV and their energy half width is 0.2 eV.

On account of these low values, ion sources in the form of thermal surfaces are particularly well suited as sources for ion microbeams, which can be employed for ion microetching and ion microanalysis by the use of sputtering, or for ion implantation. Other ion sources (duo-plasmatron sources, field ion sources) employed for this purpose have considerably larger energy spreads which results in a relatively high chromatic aberration during microfocussing through an electrostatic lens. The smaller is the energy spread of the ion beam, the smaller will be the spot size for a given beam current within the range of very small spot dimensions, where the chromatic aberration preponderates. The beam current is then still proportional to the brightness of the source, which itself is inversely proportional to the initial energy and proportional to the current density.

OBJECT OF THE INVENTION

The object of the invention is to provide an ion source of the thermal surface ionization type delivering primarily "monochromatic" ions at a higher current density than the known ion sources of this type.

BRIEF SUMMARY OF THE INVENTION

According to the invention this object is achieved by an arrangement in which the heated ionizing surface is convexly curved in the direction towards the acceleration electrode and has a radius of curvature which is small as compared with the length of the acceleration path.

Accordingly, in the ion source according to the present invention, the hot ionizing surface is convexly curved in the outward direction, and the curvature is such that the radius of curvature r is small compared with the length of the acceleration path d. In general r/d should be less than 1/5, preferably smaller than 1/10. In such a case the field strength at the electrode in the currentless condition is of the order of magnitude of V/r, and is therefore large as compared with that in a plane arrangement where the field strength is V/d. Under this condition, the produced ions are accelerated more quickly away from the hot surface and the formation of a current limiting space charge is avoided, so that the saturation current density can be reached. On the other hand, however, the field strength at the hot surface must not be so great as to allow field ionization of the vapour atoms to occur, because then the energy spread would be substantially higher. Field ionization takes place, depending upon the type of vapour, at field strengths of $E_i > 1$ V/nm. A correct range of values for the radius of curvature r is therefore given by the preferred limits:

$$V/E_i < r << d. \quad (4)$$

For example, for V=10 kV, $E_i$=1 V/nm, d=5 mm, we obtain 10 $\mu$m<r<500 $\mu$m.

The ionizing surface may be designed as a heated pin with a rounded end or as a hairpin filament cathode. Such sources have only a small virtual diameter, whereby they are well suited as sources for ion microbeams. The virtual magnitude of the beam source is proportional to r, whilst the brightness of the beam does not depend upon r within the above limits.

BRIEF DESCRIPTION OF DRAWINGS

A practical arrangement of thermal surface ion source in accordance with the invention will now be more particularly described by way of example with reference to the accompanying drawing, wherein.

DESCRIPTION OF EMBODIMENTS

Figure 1:
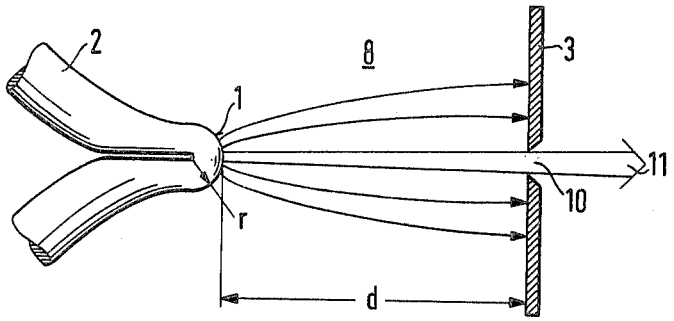
FIG. 1 shows an elevation, partly in section, of a part of the arrangement.
Figure 2:
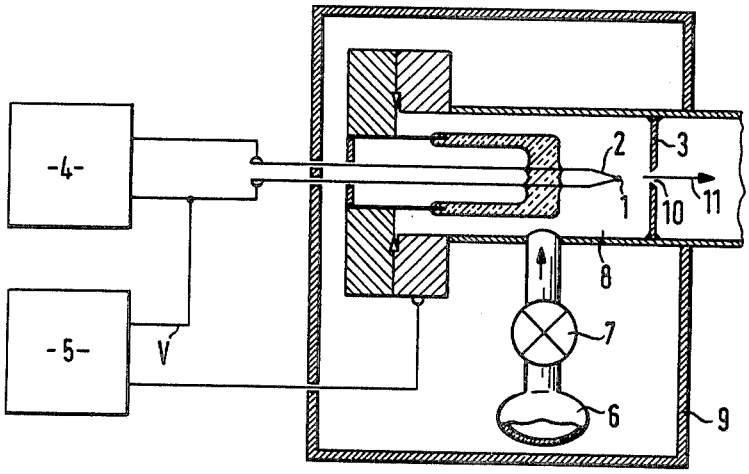
FIG. 2 is a somewhat simplified sectional view of an arrangement according to a preferred practical form of the invention.

The arrangement shown includes a double bent hot wire filament 2, which is shaped somewhat like a hairpin cathode, and the bent portion of which is formed as a round domes with a radius of curvature r. For the production of positive ions, for example alkali metal ions, a heater wire is employed of a high work function, for example tungsten or iridium, so that the condition W−I>0.4 eV is satisfied. For the production of negative ions, a heater wire of a metal having a lower work function is employed, such as hafnium or thorium, or a heater wire is used which is coated with a layer of a material of low work function, for example with $LaB_6$, so that the condition E−W>0.4 eV is satisfied.

At a distance d in front of the apex of the dome 1 of the heater wire 2, there is arranged an acceleration or extraction electrode 3 in the form of an annulus, the outer periphery of which is secured to a cylindrical housing surrounding the heater filament and its connecting lead.

The heater filament 2 is connected to a source of heating voltage 4 and to one terminal of a source 5 for delivering an acceleration voltage V. The other terminal of the acceleration source 5 is connected to the extraction electrode 3. The current and voltage sources 4 and 5 may be operated from a mains supply network.

The atoms to be ionized are conveyed out of a supply container 6 through a valve 7 into an ionization chamber 8, within which is situated the heater filament 2 with the dome 1. For producing alkali ions the arrangement is contained in a furnace 9, which heats the arrangement including the alkali contained in the supply container 6 to such a temperature that the desired vapour pressure of the atoms to be ionized is established at the surface of the dome 1. The halogens (including iodine) possess, even at room temperature, a sufficiently high vapour pressure in the supply container 6.

The atoms striking the surface of the dome 1 are ionized and are accelerated therefrom by the voltage V to the extraction electrode 3. The centrally positioned portion of the ions passes through the aperture 10 in the electrode 3 in the form of a beam 11 with the energy eV, and enters a vacuum chamber of the apparatus which is an accessory to the ion source.

Instead of using a hot wire coated with $LaB_6$ it is possible to use as the ionizing surface a directly or indirectly heated pin or $LaB_6$ rounded at one of its end faces.

Practical values of r and d are:

r=0.4 mm d=5.0 mm.

The temperature of the contact ionization electrode may, for example, be about 1100° to 1200° C. in the case of the production of $Cs^+$ ions upon tungsten, and in the case of the production of $I^-$ ions upon $LaB_6$ may be about 1200° to 1300° C.

The acceleration or extraction voltage V may lie between 5000 and 15,000 volts.

What is claimed is:

1. In an arrangement for producing a beam of accelerated ions comprising a heated ionizing surface at which atoms are ionized by contact therewith and an acceleration electrode towards which the ions produced at the heated surface are accelerated along an acceleration path, the improvement that the heated surface is constituted by the domed end of a heater wire which is convexly curved towards the acceleration electrode with a radius of curvature which is small compared with the length of the acceleration path.

2. An arrangement according to claim 1, wherein the radius of curvature of the ionizing surface is less than one fifth of the length of the acceleration path.

3. An arrangement according to claim 2, wherein the radius of curvature of the ionizing surface is less than one tenth of the length of the acceleration path.

4. An arrangement according to claim 1, wherein for the production of positive ions, the heated surface comprises a material satisfying the condition:

$$W - I > 0.4 \text{ eV},$$

where

W is the electron work function of the heated surface, and

I is the ionization work of the atoms.

5. An arrangement according to claim 1, wherein for the production of negative ions, the heated surface comprises a material satisfying the condition:

$$E - W > 0.4 \text{ eV},$$

where

W is the electron work function of the heated surface, and

E is the electron affinity of the atoms.

6. An arrangement according to claim 1, wherein the acceleration electrode is constituted by an annulus through which the beam of ions is accelerated.

7. An arrangement according to claim 1, in which the ionizing surface is heated to 1200° C.±100° C.

8. An arrangement according to claim 1, in which the acceleration electrode carries an accelertion voltage of between 5000 and 15000 volts.

9. In an arrangement for producing a beam of accelerated ions comprising a heated ionizing surface at which atoms are ionized by contact therewith and an acceleration electrode towards which the ions produced at the heated surface are accelerated along an acceleration path, the improvement that the heated surface is convexly curved towards the acceleration electrode in accordance with the following relationship between the acceleration voltage V between the heated ionizing surface and the acceleration electrode, the radius of curvature R of the heated surface and the spacing distance d between the heated surface and the acceleration electrode:

$$V/E_1 < R << d,$$

wherein $E_1 = 1$ volt/nanometer.

10. An arrangement according to claim 9, wherein the radius of curvature R of the ionizing surface is less than one fifth of the spacing distance d.

11. An arrangement according to claim 10, wherein the radius of curvature R of the ionizing surface is less than one tenth of the length of the spacing distance d.

12. An arrangement according to claim 9, wherein for the production of positive ions, the heated surface comprises a material satisfying the condition:

$$W - I > 0.4 \text{ eV},$$

where

W is the electron work function of the heated surface, and

I is the ionization work of the atoms.

13. An arrangement according to claim 9, wherein the heated surface comprises a material satisfying the condition:

$$E - W > 0.4 \text{ eV},$$

where

W is the electron work function of the heated surface, and

E is the electron affinity of the atoms.

14. An arrangement according to claim 9, wherein the heated surface is formed by the domed end of a heater wire.

15. An arrangement according to claim 9, wherein the acceleration electrode is constituted by an annulus through which the beam of ions is accelerated.

16. An arrangement according to claim 9, in which the ionizing surface is heated to 1200° C.±100° C.

17. An arrangement according to claim 9, in which the acceleration electrode carries an acceleration voltage of between 5000 and 15,000 volts.

18. A method of producing a beam of accelerated ions, comprising the steps of preparing an ionizing surface with a surface convexly curved towards an acceleration electrode in accordance with the following relationship between the acceleration voltage V between the heated ionizing surface and the acceleration electrode, the radius of curvature R of the heated surface and the spacing distance d between the heated surface and the acceleration electrode:

$$V/E_i < R << d,$$

wherein $E_i = 1$ volt/nanometer, heating the ionizing surface, applying an acceleration voltage between said surface and said electrode, and contacting the heated ionizing surface with ionizable atoms.

* * * * *